US005913907A

United States Patent [19]

Lee

[11] Patent Number: 5,913,907

[45] Date of Patent: Jun. 22, 1999

[54] LOCK FOR SECURING A PORTABLE COMPUTER OR THE LIKE

[76] Inventor: Miko Lee, No. 5, Li Hsing Lane, Chung Cheng Rd., Hsin Chuang City, Taipei Hsien, Taiwan

[21] Appl. No.: 09/069,912

[22] Filed: Apr. 30, 1998

[51] Int. Cl.[6] ..... E05B 65/00

[52] U.S. Cl. ..... 70/58; 70/14; 70/57; 70/491; 248/551

[58] Field of Search ..... 70/14, 18, 30, 70/57, 58, 49, 232, 491; 248/551–553

[56] References Cited

U.S. PATENT DOCUMENTS

| | | | |
|---|---|---|---|
| 5,327,752 | 7/1994 | Myers et al. | 70/57 X |
| 5,381,685 | 1/1995 | Carl et al. | 70/57 X |
| 5,493,878 | 2/1996 | Murray, Jr. et al. | 70/58 |
| 5,548,981 | 8/1996 | Kirk | 70/58 |
| 5,622,064 | 4/1997 | Gluskoter et al. | 70/58 X |
| 5,687,592 | 11/1997 | Penniman et al. | 70/58 X |
| 5,692,400 | 12/1997 | Bliven et al. | 70/58 |
| 5,709,110 | 1/1998 | Greenfield et al. | 70/58 |

*Primary Examiner*—Suzanne Dino Barrett
*Attorney, Agent, or Firm*—Gardere & Wynne, LLP; Sanford E. Warren, Jr.

[57] ABSTRACT

A lock including a latch bolt securely extending out therefrom and having a pair of geometrically opposed channels defined therein and a wall formed near a distal end thereof, a pair of locking pins slidably received within respective channels of the latch bolt and a pad attached to an outer periphery of a stator of the lock enables a user to laterally insert the lock into a predetermined hole defined in a cover of a portable computer or the like to secure the portable computer. Furthermore, due to the provision of a wire and a loop at a distal end of the wire which is securely attached to the periphery of the stator, the portable computer or the like is able to be securely attached to an object suitable for the wire to be attached.

3 Claims, 6 Drawing Sheets

LOCK FOR SECURING A PORTABLE COMPUTER OR THE LIKE

FIELD OF THE INVENTION

The present invention generally relates to a lock, and more particularly to a lock for securing a portable computer or the like. The lock is able to project a locking pin extending into a hole defined in the notebook computer when a proper key is applied to the lock, to that the portable computer will not be stolen. Furthermore, a first end of a wire is securely connected to the lock and a loop is formed on a second end of the wire, such that the lock is able to secure the notebook computer to any suitable object.

BACKGROUND OF THE INVENTION

Light weight and small size are the main reasons for the popularity of notebook computers. The boundaries between nations and even individuals are more and more blurred, because the existence of INTERNET brings everything even closer than ever before. Therefore, in order to have updated information, people who travel a lot often bring along a notebook computer, so that he/she may have the notebook computer connected to the internet in a so called "INTERNET CAFE" to work on his/her schedule or other related business. However, although the notebook computer is very convenient, problems still happen to the users especially when the notebook computer is connected to the INTERNET and is transmitting information. The transmitting speed of information in the internet is limited by the size of the file and also the quality of the phone line, so users often find themselves sitting in front of the computer waiting for the information to show up in the screen. While waiting, users may leave the computer for a while to take care of another matter, and during this period of the users' absence, someone may easily steal the computer, which causes a lot of trouble to the uses. Although there are many different locks in the market, none of them is designed to prevent the notebook computer from being stolen.

From the previous description, it is noted that regardless of the large quantity of locks in the market, alternatives and/or improvement(s) to those locks are thus required for the purpose of preventing the portable computer or the like from being stolen. A lock for securing a portable computer and constructed in accordance with the present invention tends to mitigate and/or obviate the aforementioned problems.

SUMMARY OF THE INVENTION

The main object of the present invention is to provide a lock for securing a portable computer or the like to a suitable object. The lock is able to project a locking pin into a pre-defined hole in a housing of the portable computer, and then with the configuration of the locking pin, rotating the locking pin for a predetermined angle will thus secure the portable computer with the lock.

Another object of the present invention is to provide a loop to the lock, so that the lock together with the portable computer is able to be secured to a suitable object via the loop.

Other objects, advantages and novel features of the invention will become more apparent from the following detailed description when taken in conjunction with the accompanying drawings.

Figure 2A:
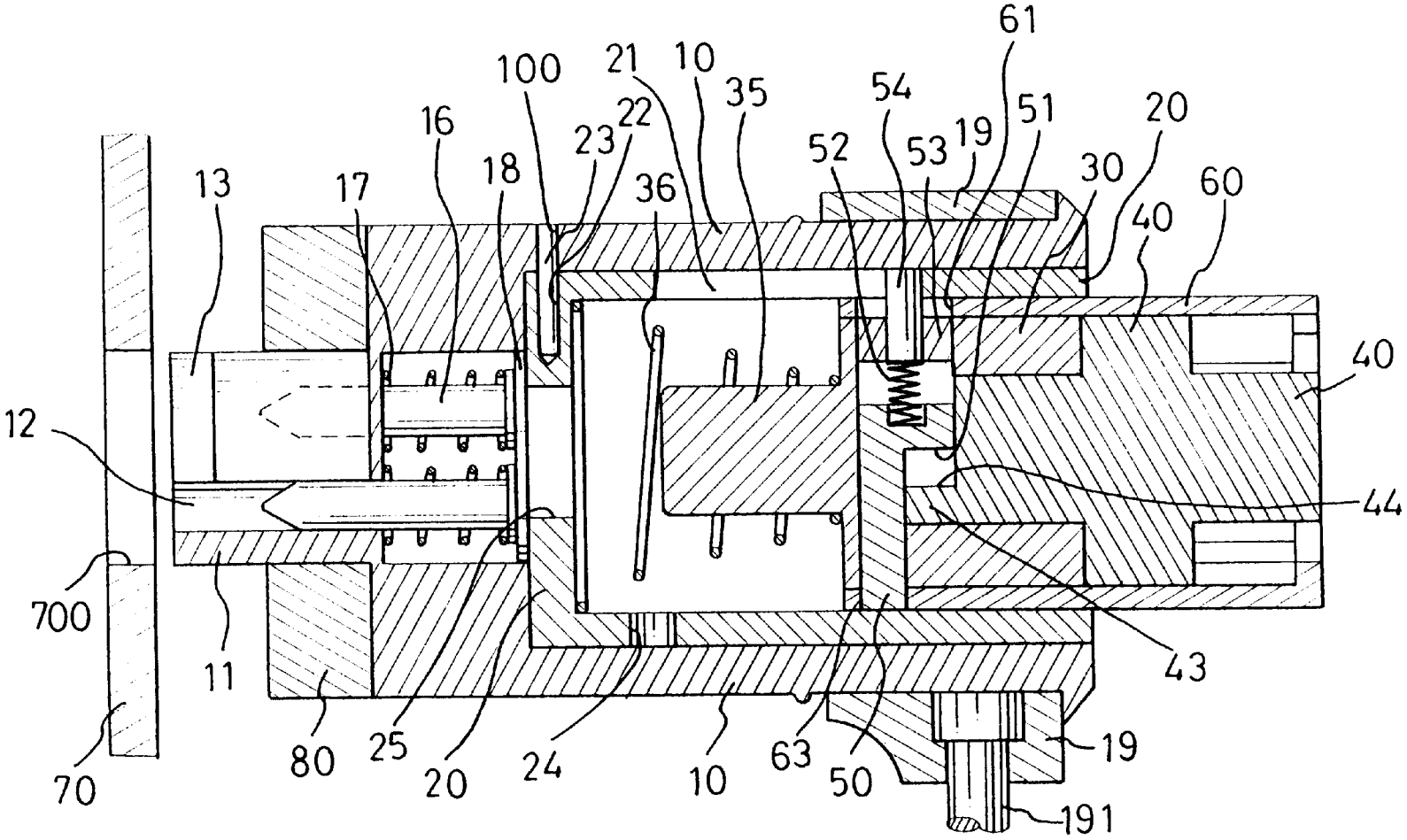
FIG. 2A is a cross sectional view of a lock of the preferred embodiment shown in FIG. 1.
Figure 2B:
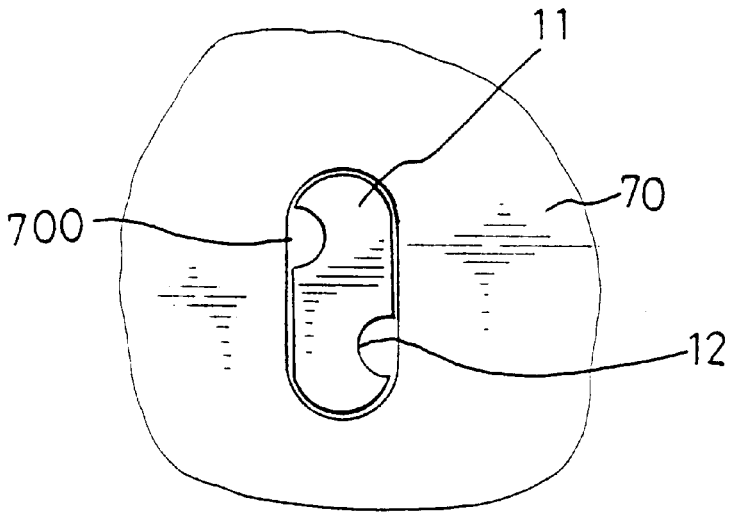
Figure 3B:
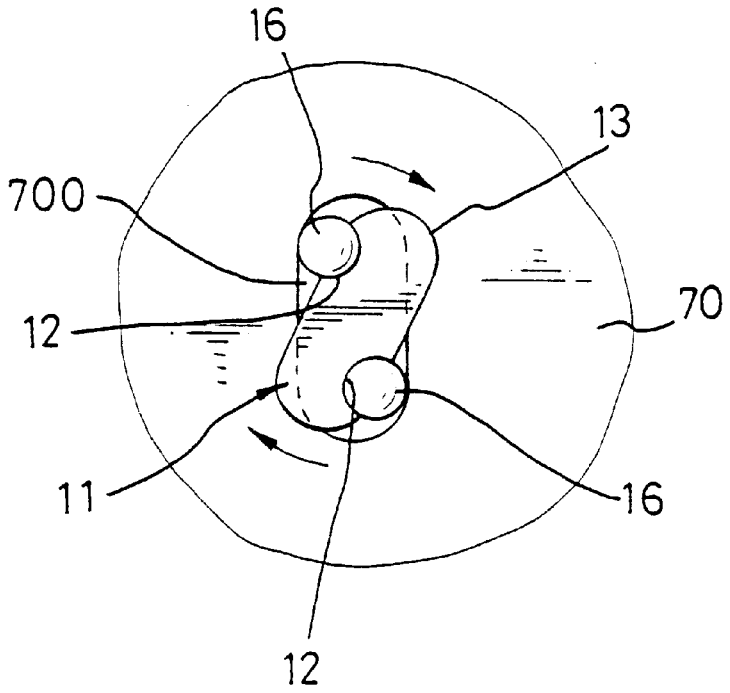
Figure 3A:
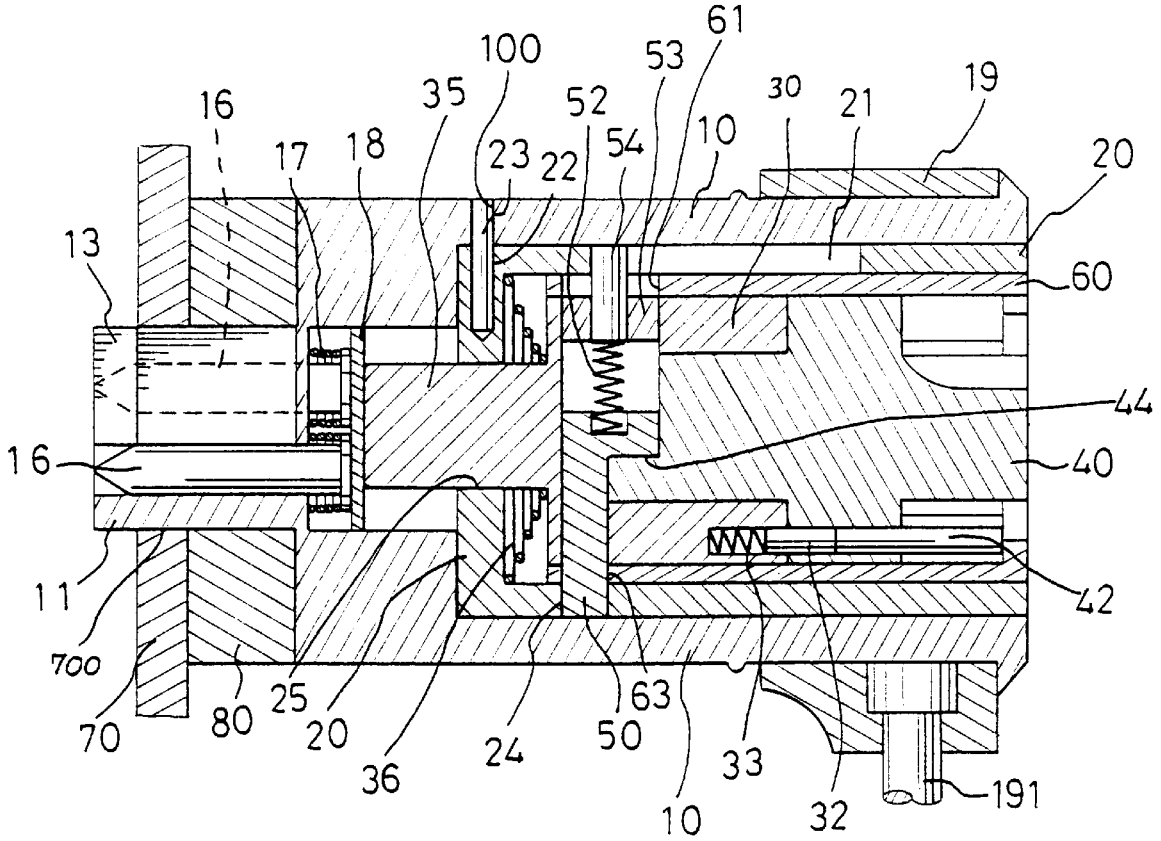
Figure 4:
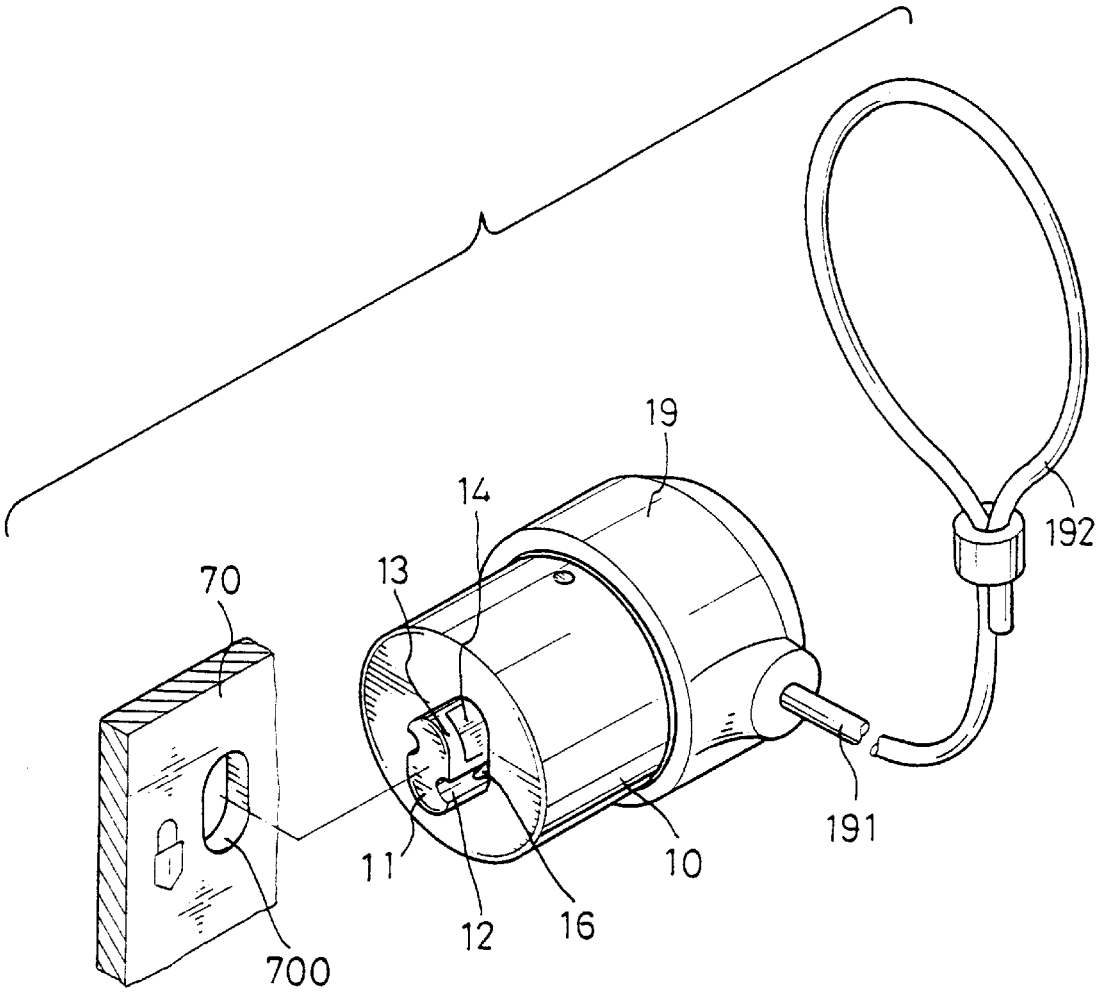
Figure 5:
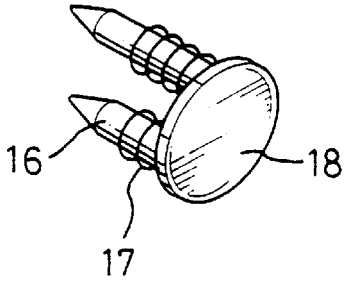
Figure 6:
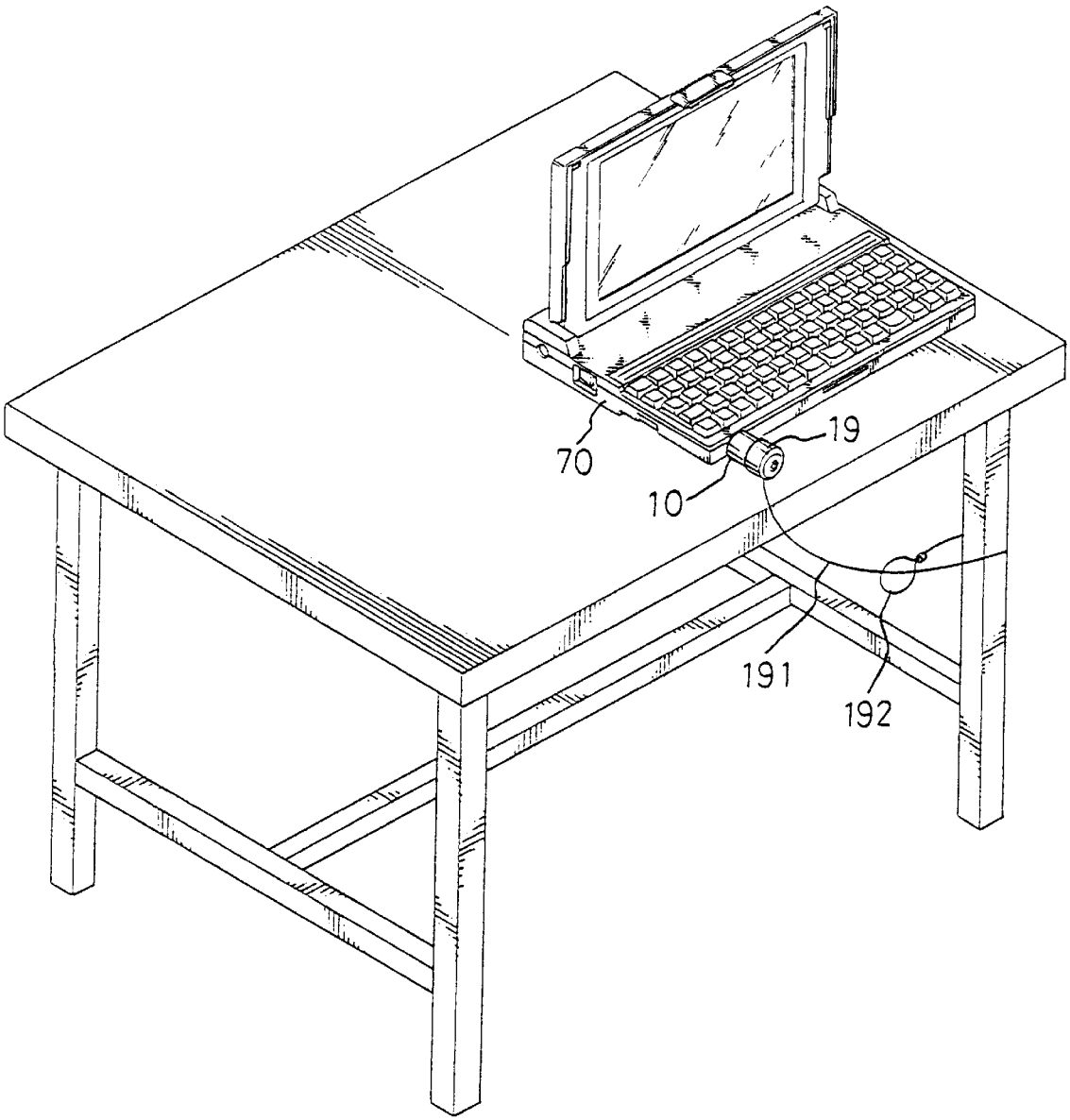

FIG; 2B is all end view of the lock shown in FIG. 2B;

FIG. 3A Is a schematic view showing operation of the lock of the invention;

FIG. 3B is a schematic end view showing a rotation of a latch bolt of the invention;

FIG. 4 is a perspective view showing characteristics of the lock of the invention;

FIG. 5 is a perspective view of a locking pin constructed in accordance with the present invention; and FIG. 6 is a schematic view showing securing of the portable computer to a suitable object via the lock together with the loop of the invention.

DETAILED DESCRIPTION OF PREFERRED EMBODIMENT

Referring to FIG. 4 and FIG. 6, a cylindrical lock having a cylinder 19 and a stator 10 securely received within the cylinder 19. The cylinder 19 has a seat 190 peripherally formed to receive a wire 191 having a loop 192 formed on a distal end thereof. The stator 10 has a latch bolt 11 axially extending out therefrom. The latch bolt 11 has a pair of geometrically opposed channels 12 and a cutout 14 defined therein, such that a wall 13 is formed between a distal end of the latch bolt 11 and the cutout 14. A pair of locking pins 16 are respectively and slidably received within one of the channels 12 of the latch bolt 11. After the latch bolt 11 is laterally inserted into a hole 700 defined in a cover 70 of a portable computer (not shown) and the pair of locking pins 16 are urged toward the hole 700 by a locking procedure of the lock, the wall 13 is able to securely engage against a rear face of the cover 70, such that the portable computer is secured by the lock after the latch bolt 11 is rotated for a predetermined angle. Furthermore, due to the wire 191 and the loop 192 formed on the distal end of the wire 191, which are both securely connected with the cylinder 19 of the lock, the portable computer or the like will be secured to an object suitable for the wire 191 and the loop 192 to be attached. It is therefore, any kind of locks comprising a latch bolt 11 securely received therein and having a pair of geometrically opposed channels 12 defined therein, a cutout 14 peripherally defined in the latch bolt 11 and a wall 13 formed between distal end of the latch bolt 11 and the cutout 14 and at least one locking pin 16 respectively and slidably received within one of the channels 12 and being able to accomplish a lateral insertion of the latch bolt 11 into a hole 700 predefined in a cover 70 of the portable computer is within the scope of the present invention and it is obvious that after the disclosure of the detailed structure of the invention, alternation, changes and/or modification to the lock of the invention will still be within the scope of the invention without departing from the spirit of the invention.

For a better understanding of the invention, a preferred embodiment of the present invention is described in detail hereinafter.

Figure 1:
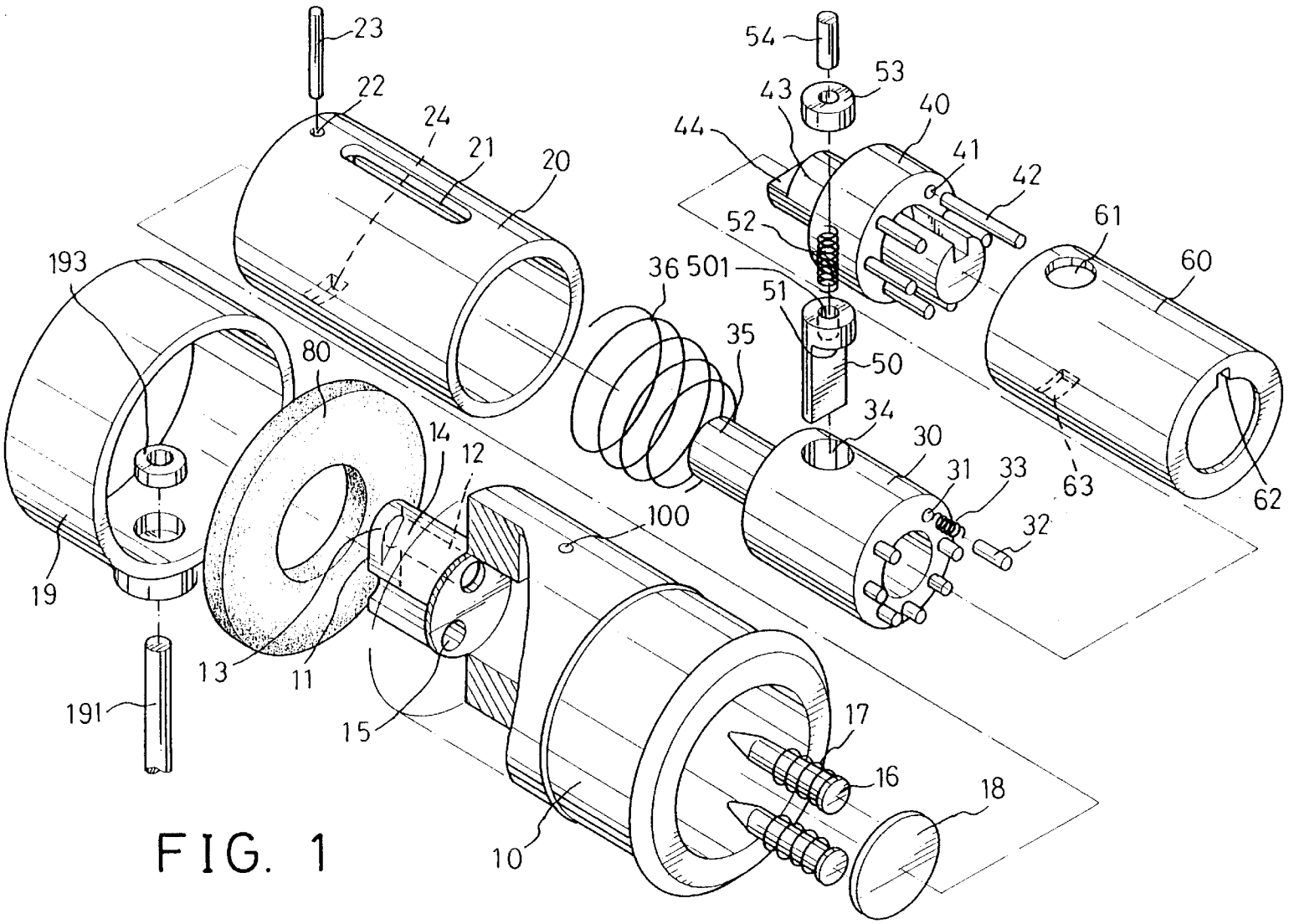
FIG. 1 is an exploded view of a preferred embodiment of the present invention.

Referring to FIG. 1, an exploded view of a lock having the above mentioned characteristics is shown. The lock has a hollow cylindrical body 60 having a first hole 61 and a first through hole 63 circumferentially defined therein, a first bearing seat 40 slidably received within the body 60 and having a plurality of apertures 41 peripherally defined in one end side thereof, a plurality of first pin tumblers 42 respectively and securely receive within one of the apertures 41 and an extension 43 axially formed in the central portion thereof and having a first slit 431 peripherally defined therein to correspond to a recessed channel 62 defined in an inner face of the body 60 to allow a key (not shown) to be inserted therein and a first flat portion 44 defined in a distal end thereof, a hollow second bearing seat 30 having a plurality of second apertures 31 peripherally defined in one end side thereof, a plurality of pin tumblers 32 respectively and slidably received within one of the plurality of second apertures 31 after a plurality of first springs 33 are respectively inserted into one of the second apertures 31, an abutting member 35 axially extending out therefrom and a second hole 34 longitudinally defined to communicate with an inner space thereof thereby allowing a retainer 50 having a second flat portion 51 defined therein and a recess 501 defined therein, a second spring 52, a plug 53 having a central hole defined therethrough and a first pin 54 to be sequentially inserted therein, a sleeve 20 slidably engaged with the body 60, the first bearing seat 40 and the second bearing seat 30 and having a second slit 21 peripherally defined therein for allowing the first pin 54 to be slidably received therein, a second through hole 24 peripherally defined to correspond the second slit 21 and allowing a distal end of the retainer 50 to be inserted therein and a first bore 22 peripherally defined for allowing a second pin 23 to be inserted therein, a stator 10 having a second bore 100 circumferentially defined to correspond the first bore 22 of the sleeve 20 thereby allowing the second pin 23 to be inserted therethrough, a latch bolt 11 slidably received within the stator 10 and having a pair of geometrically opposed channels defined therein, a cutout 14 peripherally defined therein and a wall 13 fortified between a distal end of the latch bolt 11 and the cutout 14, a pair o)f locking pins 16 respectively and slidably received within one of the channels 12 and each having a coil spring 17 mounted around, a plate 18 securely attached to distal ends of both of the locking pins 16, a pad 80 securely attached to an end face of the stator 10 and a cylinder 19 secured mounted outside of the stator 10. In order to provide a resilience to the first bearing seat 40 and the second bearing seat 30 to extend out of the sleeve 20, a spring 36 is mounted around the abutting member 35 of the second bearing seat 30. For the purpose of urging against the spring 36 and meantime allowing the abutting member 35 to have engagement with the plate 18, the sleeve 20 has a flange 25 (as shown in FIG. 2A) formed on an end face thereof and a centrally defined through hole 25 (as shown in FIG. 2A) having a diameter greater than a diameter of the abutting member 35 of the second bearing seat 30, such that the abutting member 35 is able to extend through the through hole 25 of the sleeve 20 and engages with the plate 18.

It is to be noted from FIG. 2A that, in assembly, the extension 43 of the first bearing seat 40 extends into a central hole (not numbered) of the second bearing seat 30 and the retainer 50, the second spring 52, the plug 53 and the first pin 54 are sequentially inserted into the second hole 34 of the second bearing seat 30. When the body 60 is mounted outside the first bearing seat 40 and the second bearing seat 30, a first distal end of the first pin 54 extends through the first hole 61 and is slidably received within the second slit 21 of the sleeve 20 after the sleeve 20 is mounted outside the body 60 and a distal end of the retainer 50 extends through the first through hole 63. Before the sleeve 20 is mounted outside the body 60, the spring 36 is mounted between an inner face of the flange 25 and the second bearing seat 30 and a distal end of the spring 36 engages the inner face of the flange 25 and the other distal end of the spring 36 engages a joint (not numbered) of the abutting member 35 and the second bearing seat 30. After the pair of locking pins 16 are slidably inserted into the respective channels 12 of the latch bolt 11 and the latch bolt 11 together with the plate 18 is securely positioned within the stator 10, the stator 10 is encased the sleeve 20. Due to the correspondence of the first bore 22 with the second bore 100, the second pin 23 is able to be inserted through the first bore 22 and the second bore 100 respectively and a free end thereof is riveted to be flush with an outer periphery of the stator 10. The first pin 54, due to the secure engagement between the sleeve 20 and the stator 10, is pressed toward the recess 501 of the retainer 50, such that the retainer 50 is kept urging by the second sprint 52. In usual, the first bearing seat 40 and the second bearing seat 30 extend out from the body 60 because of the resilience of the spring 36. After the lath bolt 11 is aligned with a hole 700 predetermined in a cover 70 of a portable computer (not shown) or the like, a user will be able to readily and laterally insert the latch bolt 11 into the hole 700, as shown in FIG. 2B. However, in order to fill in a gap (not shown) between the end face of the lock between the cover 70, a pad 80 made of durable material is applied therebetween, so that the lock is able to have a firm connection with the cover 70.

When the user is proceeding a locking procedure to the lock of the invention, as shown in FIG. 3A, the first bearing seat 40 and the second bearing seat 30 are pushed inward, thus a distal end of the retainer 50 will correspondingly fall into the second through hole 24 of the sleeve 20. Accordingly, clue to the push to the first bearing seat 40 and the second bearing seat 30, the pair of locking pins 16, being pushed by the abutting member 35 to the plate 18, is extending out from the channels 12 respectively and fills the hole 700 of the cover 70.

If the user continues to rotate the latch bolt 11, the wall 13 will be able to securely engage with an inner face of the cover 70, as shown in FIG. 3B.

Referring to FIG. 5, another embodiment of the invention is shown. The pair of locking pins 16 and the plate 18 are formed into one piece, so that number of parts will be reduced and handling thereof will be much easier than before.

Referring to FIG. 6, due to the provision of the loop 192 at the distal end of the wire 191, the user is able to take the lock of the invention to insert through the loop 192 and then into the hole (not shown) predetermined in a cover 70 of the portable computer or the like, such that the portable computer is secured via the wire 191.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. A lock having an abutting member slidably received within a stator, wherein the improvements comprise:

a latch bolt extending out from the stator and rotatably received in the stator and having a pair of geometrically opposed channels peripherally defined therein, a cutout peripherally defined therein and a wall formed between a distal end of the latch bolt and the cutout; and a pair of locking pins slidably received within respective channels of the latch bolt and detachably abutted by the abutting member and each having a coil spring mounted around an outer face thereof.

2. The lock as claimed in claim 1 further having a pad securely attached to an outer face of the stator.

3. The lock as claimed in claim 1, wherein the pair of locking pins and a plate are formed into one piece.

* * * * *